US011584560B2

(12) United States Patent
Campbell

(10) Patent No.: US 11,584,560 B2
(45) Date of Patent: Feb. 21, 2023

(54) JAR ASSEMBLY

(71) Applicant: ANOMATIC CORPORATION, New Albany, OH (US)

(72) Inventor: Stephen Grimmer Campbell, New Albany, OH (US)

(73) Assignee: ANOMATIC CORPORATION, New Albany, OH (US)

( * ) Notice: Subject to any disclaimer, the term of this patent is extended or adjusted under 35 U.S.C. 154(b) by 83 days.

(21) Appl. No.: 15/929,382

(22) Filed: Apr. 29, 2020

(65) Prior Publication Data

US 2020/0346813 A1 Nov. 5, 2020

Related U.S. Application Data

(60) Provisional application No. 62/840,714, filed on Apr. 30, 2019.

(51) Int. Cl.
*B65D 1/26* (2006.01)
*B65D 23/02* (2006.01)
(Continued)

(52) U.S. Cl.
CPC ..... *B65D 1/26* (2013.01); *B65D 1/0246* (2013.01); *B65D 23/02* (2013.01); *B65D 2543/00277* (2013.01); *C25D 11/16* (2013.01)

(58) Field of Classification Search
CPC ..... B65D 1/26; B65D 1/0246; B65D 23/02; B65D 2543/00277; B65D 85/72;
(Continued)

(56) References Cited

U.S. PATENT DOCUMENTS 2,785,796 A 3/1957 Gelardin
2,866,569 A 12/1958 Morrison
(Continued)

FOREIGN PATENT DOCUMENTS

CN 205256965 U 5/2016
CN 205470510 U 8/2016
(Continued)

*Primary Examiner* — Shawn M Braden
(74) *Attorney, Agent, or Firm* — Vorys, Sater, Seymour and Pease LLP; Mark A. Watkins

(57) ABSTRACT

The present disclosure is related to jars and containers and, more particularly, to the manufacture of readily recyclable jars and containers.

An exemplary jar is comprised of an aluminum base and a first aluminum inner cup provided with a first cavity defined with the aluminum base. An outer thread is provided about an exterior surface of the aluminum base, and an aluminum lid with a second aluminum inner cup is provided within a second cavity defined within the aluminum lid. An inner thread mateable with the outer thread is provided about an interior surface of the second aluminum inner cup.

A method of manufacturing readily recyclable jars can comprise providing a primary metal material and optionally applying a precoating to the primary metal material. The primary metal material may be formed into a jar with mating threads and a lid with mating threads. The primary metal material may optionally be finished. A liner may optionally be inserted. The lid and jar are then assembled, and a plastic cup may optionally be installed.

20 Claims, 10 Drawing Sheets

(51) Int. Cl.
*B65D 1/02* (2006.01)
*C25D 11/16* (2006.01)

(58) Field of Classification Search
CPC .. B65D 41/34; B65D 1/0215; B65D 23/0885; C25D 11/16
See application file for complete search history.

(56) References Cited

U.S. PATENT DOCUMENTS 4,444,324 A 4/1984 Grenell
4,651,397 A * 3/1987 Martin Saint Leon ..... A45D 40/0068 29/243.517
5,785,198 A 7/1998 Credle, Jr.
6,276,547 B1 * 8/2001 Petryna ..... B65D 21/083 220/4.03
7,913,866 B2 * 3/2011 Bodenbender ..... A45D 40/0068 220/23.89
8,132,578 B2 3/2012 LoPrete
8,448,801 B2 5/2013 Rusnak et al.
8,678,211 B1 3/2014 Lin
2006/0099363 A1 * 5/2006 Farha ..... C09D 163/00 427/372.2
2008/0035646 A1 2/2008 Smith
2009/0039080 A1 * 2/2009 Bodenbender ..... A45D 40/0068 220/23.83
2009/0266737 A1 10/2009 Cole
2014/0312040 A1 * 10/2014 Gamelli ..... B65D 43/02 53/471
2016/0280426 A1 9/2016 Kim
2017/0217635 A1 8/2017 Johnson
2018/0125198 A1 5/2018 Burditt et al.
2018/0194049 A1 * 7/2018 Wada ..... B29C 45/1635
2019/0031386 A1 * 1/2019 Ishii ..... B32B 27/36
2019/0315535 A1 * 10/2019 Karll ..... B65D 50/041

FOREIGN PATENT DOCUMENTS

CN 208731588 U 4/2019
CN 2088631667 U 5/2019
DE 102007060475 A 6/2009

* cited by examiner

JAR ASSEMBLY

CROSS-REFERENCE TO RELATED APPLICATIONS

This application claims priority to and the benefit of U.S. Provisional Application No. 62/840,714 filed Apr. 30, 2019, which is incorporated by reference herein in its entirety.

BACKGROUND

Jars and related containers are used to provide a practical, convenient and means of containing makeup, creams, powders, emulsions and other products for consumers. Once the contents of the container have been fully utilized or the consumer is otherwise ready to dispose of the container, recycling is the most environmentally friendly and preferred disposable option. However, jars currently in distribution for consumer products are often difficult to recycle, e.g. they may have a PET plastic or glass bottom jar portion, a screw-on lid with plastic components, an inner plastic component with an outer metal shroud, metal vacuumized plastic, two piece construction that is difficult to separate, or otherwise are constructed in a manner that makes recycling the container more arduous, causing consumers to default to disposing of the containers in the trash, with attendant negative environmental impact.

Consequently, there is a need for more easily recyclable containers and methods of making the same.

SUMMARY

The present disclosure relates to jars with improved recyclability.

For example, a jar assembly, comprising an aluminum base and a first aluminum inner cup provided within a first cavity defined within the aluminum base. An outer thread is provided about an exterior surface of the aluminum base. An aluminum lid with a second aluminum inner cup is provided within a second cavity defined within the aluminum lid. An inner thread mateable with the outer thread is provided about an interior surface of the second aluminum inner cup.

A method of manufacturing jars of the present disclosure can comprise providing a primary metal material and optionally applying a precoating to the primary metal material. The primary metal material may be formed into a jar with mating threads and a lid with mating threads. The primary metal material may optionally be finished. A liner may optionally be inserted. The lid and jar are then assembled, and a plastic cup may optionally be installed.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to jars and containers and, more particularly, to the manufacture of readily recyclable jars and containers.

Currently, standard construction for jars for consumer products for household use, e.g. makeup jars for creams, powders and emulsion-type products, have a PET plastic or a glass bottom jar portion and a screw-on plastic lid, or a plastic lid with metal shroud. In order to recycle these commonly used jars, the consumer must unscrew the jar and can sometimes place the jar in a PET or glass bin in order for the jar to be recycled, but the lid remains difficult to recycle.

Figure 1:
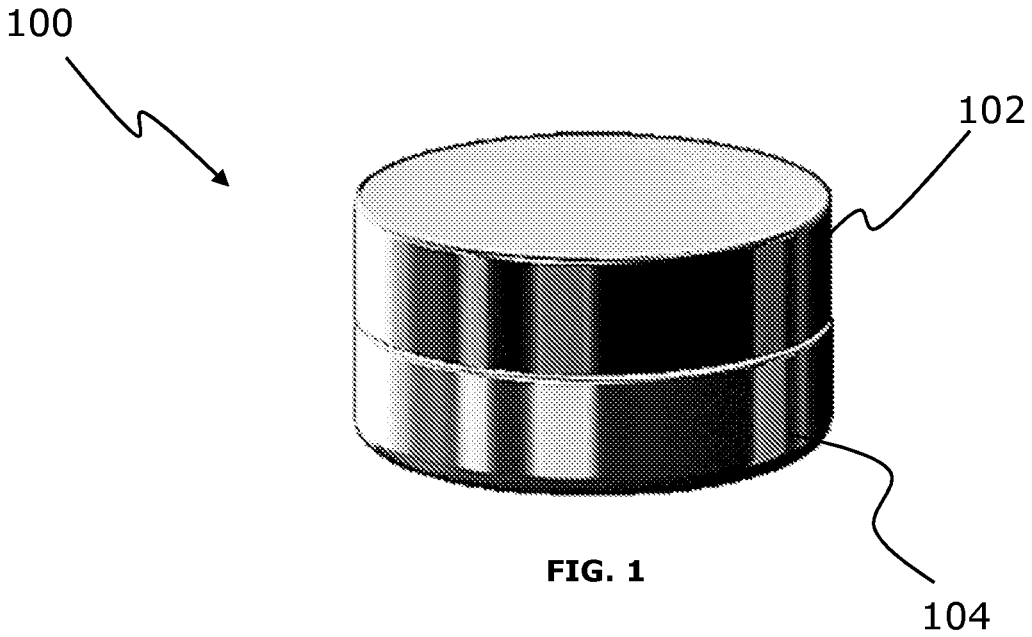
FIG. 1 is a perspective view of a jar according to one or more embodiments of the present disclosure.

FIG. 1 illustrates a jar 100 that is easily recyclable, according to one or more embodiments of the present disclosure. In the illustrated example, the illustrated jar 100 is cylindrically shaped. However, the jar 100 may have other geometries without departing from the present disclosure.

The jar 100 includes a lid assembly 102 and a jar assembly 104 (or base assembly 104). The lid assembly 102 may be fastened or secured to the jar assembly 104. However, the lid assembly 102 may be detached from the jar assembly 104 to access an internal cavity 500 (FIG. 5) of the jar 100. Thus, as described below, the lid assembly 102 attaches to the jar assembly 104 via an attachment means (e.g., mating threads). The attachment means permits a user to selective attach or detach the lid assembly 102 from the jar assembly 104. However, as illustrated, the attachment means are hidden from view when the lid assembly 102 is assembled on the jar assembly 104, which provides the jar 100 an aesthetically pleasing appearance.

Figure 2:
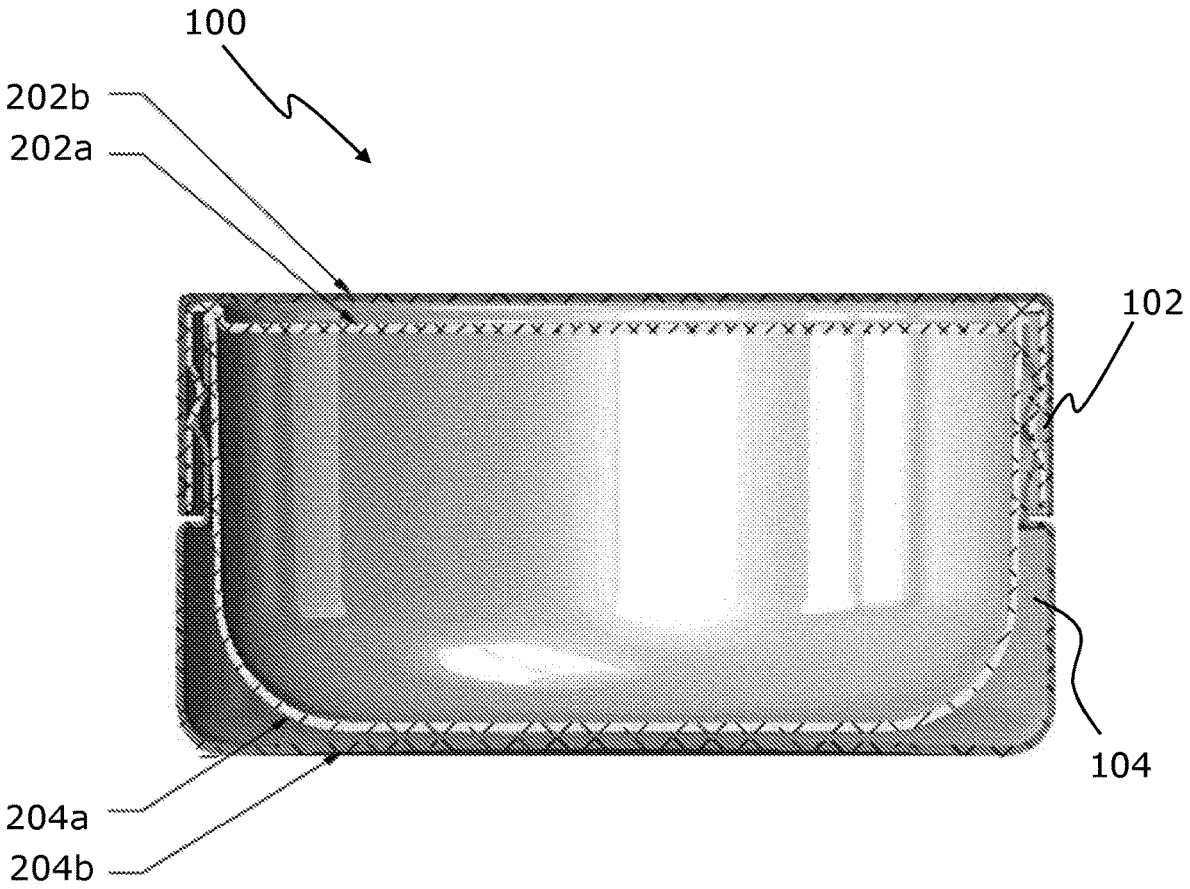
FIG. 2 is a sectional side view of the jar of FIG. 1 with the lid secured.

FIG. 2 illustrates a cross sectional view of the jar 100 of FIG. 1. In the illustrated example, the lid assembly 102 and the jar assembly 104 are each a two-piece design. Thus, the lid assembly 102 includes an inner cap 202*a* and an outer cap 202*b*, and the jar assembly 104 includes an inner cup 204*a* and an outer cup 204*b*. Also, as mentioned above, the lid assembly 102 and the jar assembly 104 may be attachable via mating threads. Thus, in the illustrated example, the mating threads are provided on an inner diameter of the lid assembly 102 and on a corresponding outer diameter of the jar assembly 104 over which the lid assembly 102 is disposed. In this manner, the threads are hidden from view when lid assembly 102 and the jar assembly 104 are assembled together.

Figure 3:
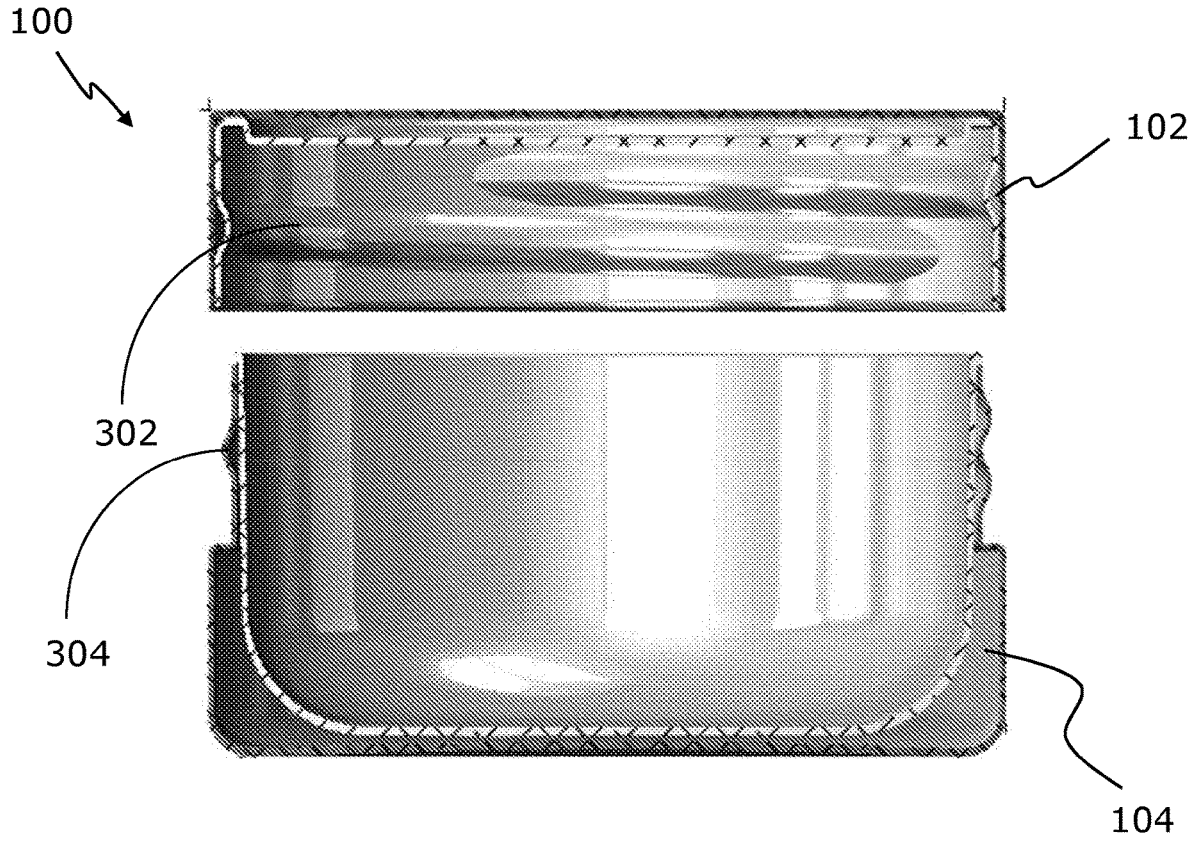
FIG. 3 is a sectional side view of the jar of FIG. 1 with the lid separated from the jar.

FIG. 3 illustrates a cross sectional view of the jar 100 of FIG. 1 when unassembled. As illustrated, a thread 302 is provided in the inner diameter of the lid assembly 102 and a corresponding thread 304 is provided on the outer diameter of the jar assembly 104. Here, the thread 302 is provided on the inner cap 202*a*, winding around an interior sidewall thereof, and covered by the outer cap 202*b* such that the thread 302 is not visible unless viewing an internal cavity of the lid assembly 102 when unattached from the jar assembly 104. Also, the corresponding thread 304 of the jar assembly 104 is provided on the outer cup 204*b*, winding around an outer sidewall thereof, to mesh with the thread 302 of the lid assembly 102. The corresponding thread 304 of the jar assembly 104 is thus visible and exposed when the jar 100 is unassembled, but hidden from view when assembled with the lid assembly 102 is secured over the jar assembly 104. In some embodiments, the jar 100 may include a secondary closure mechanism in addition to, or instead of, the corresponding threads 302, 304, for example, a magnetic closure and or interference fit closure for securing the lid assembly 102 and the jar assembly 104 together.

The jar 100 may be made entirely (or predominantly) from a metallic material; however, non-metallic materials may be utilized. In some examples, the lid assembly 102 and the jar assembly 204 are made of the same material, whereas in other examples, they are made from one or more dissimilar materials. In one example, the inner cap 202*a* and the outer cap 202*b* of the lid assembly 102 and the inner cup 204*a* and the outer cup 204*b* of the jar assembly 104 are all comprised of aluminum. Fabricating the jar 100 from (predominantly) the same metallic material will improve its recyclability. Also, fabricating the jar 100 from predominantly a metallic material provides it with a premium metallic appearance, thereby further enhancing its ability to be utilized in applications where aesthetics are desirable.

The jar 100 may also have some nonmetallic components (e.g., plastic components) and still be recyclable. For example, either or both of the inner cap 202*a* and/or the inner cup 204*a* of the lid assembly 102 and the jar assembly 104, respectively, may be made from a plastic material. In examples where the jar 100 includes one or more plastic components, such plastic components may be installed in a manner permitting the end user to easily remove it before disposal, to enhance recyclability of the jar 100. For example, the inner cup 204*a* of the jar assembly 104 may be a plastic liner that is press fit within the outer cup 204*b* in a manner permitting the end user to easily remove it from the outer cup 204*b* before disposing of the jar assembly 104. In some examples, the jar 100 includes one or more plastic components that need not be removed prior to disposal as such plastic components will be burned up in the metal recycling process. In some examples, the lid assembly 102 includes a gasket to help form a seal when attached on the jar assembly 104. The gasket may be provided on either or both of the lid assembly 102 and the jar assembly 104 to form a seal there-between. In some examples, an additional liner is provided within the inner cap 202*a* and/or inner cup 204*a*, such as a polymeric liner or removable and replaceable liner; and in some examples, a series of liners may be so provided such that they are serially removed after each use to provide a clean surface for a subsequent use.

A coating may be applied to the lid assembly 102 and/or the jar assembly 104. Various types of coating may be utilized, for example, a polymeric coating and/or a ceramic spray, and such coatings may be applied after assembly of the jar 100 or pre-coated materials may be utilized to manufacture the jar 100. In some examples, a coating is applied to interior surfaces 602, 604 (FIG. 6) of the inner cap 202*a* and/or the inner cup 204*a* of the lid assembly 102 and the jar assembly 104, respectively. For example, the inner cap 202*a* and the inner cup 204*a* may be made from aluminum and a polymeric coating applied to their interior surfaces 602, 604 defining the interior cavity of the jar 100. Here, the polymeric coating may be applied after assembly of the jar 100 or pre-coated components may be utilized to form the inner cap 202*a* and the inner cup 204*a*. The coating may be an FDA-approved polymeric coating, e.g., epoxy powdercoat.

Where metallic materials are utilized to form the jar 100, they may be anodized, for example, external surfaces 502, 504 (FIG. 5) of the lid assembly 102 and the jar assembly 104. Thus, the external surfaces 502, 504 of the outer cap 202*b* and the outer cup 204*b* may be anodized. This will provide an aesthetically pleasing and premium appearance. Also, the internal surfaces 602, 604 of the jar 100 defining the internal cavity 500 may be anodized, or at least some portion of either or both of the internal surfaces 502, 504 of the jar 100 defining the internal cavity 500 may be anodized. For example, the internal surfaces 602, 604 of the inner cap 202*a* and the inner cup 204*a* may be anodized regardless of whether the external surfaces 502, 504 are anodized. Also, at least some portion of either or both of the external surfaces 502, 504 of the jar 100 defining the internal cavity 500 may be anodized Various techniques may be utilized to form the inner cap 202*a* and the outer cap 202*b* of the lid assembly 102 and the inner cup 204*a* and the outer cup 204*b* of the jar assembly 104. For example, any or all may be formed via a deep drawing, impact extrusion, roll forming, eyelet stamping etc.

Figure 4A:
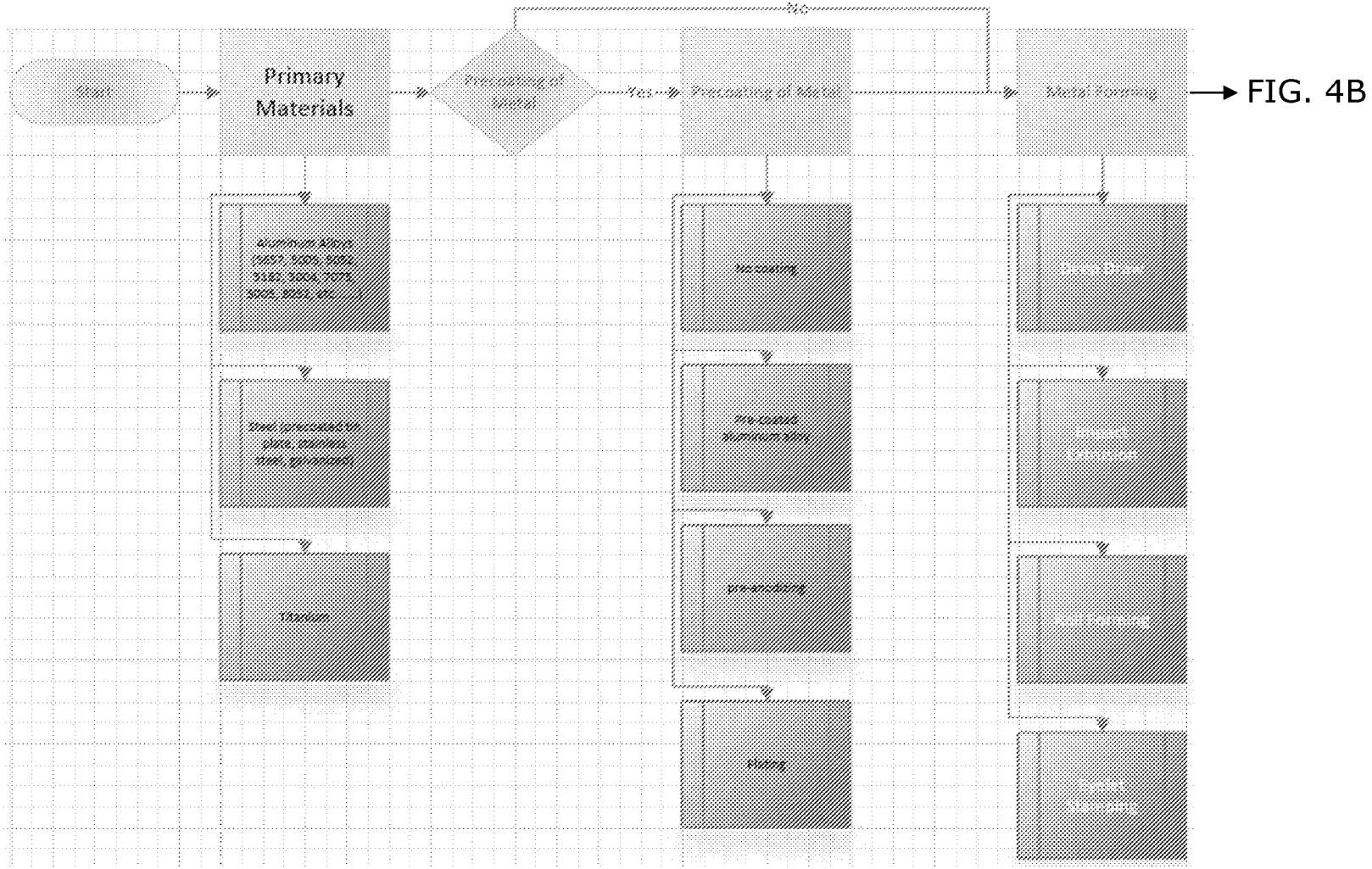
FIG. 4A is the first part of a schematic of a method of constructing jars according to the present disclosure.
Figure 4B:
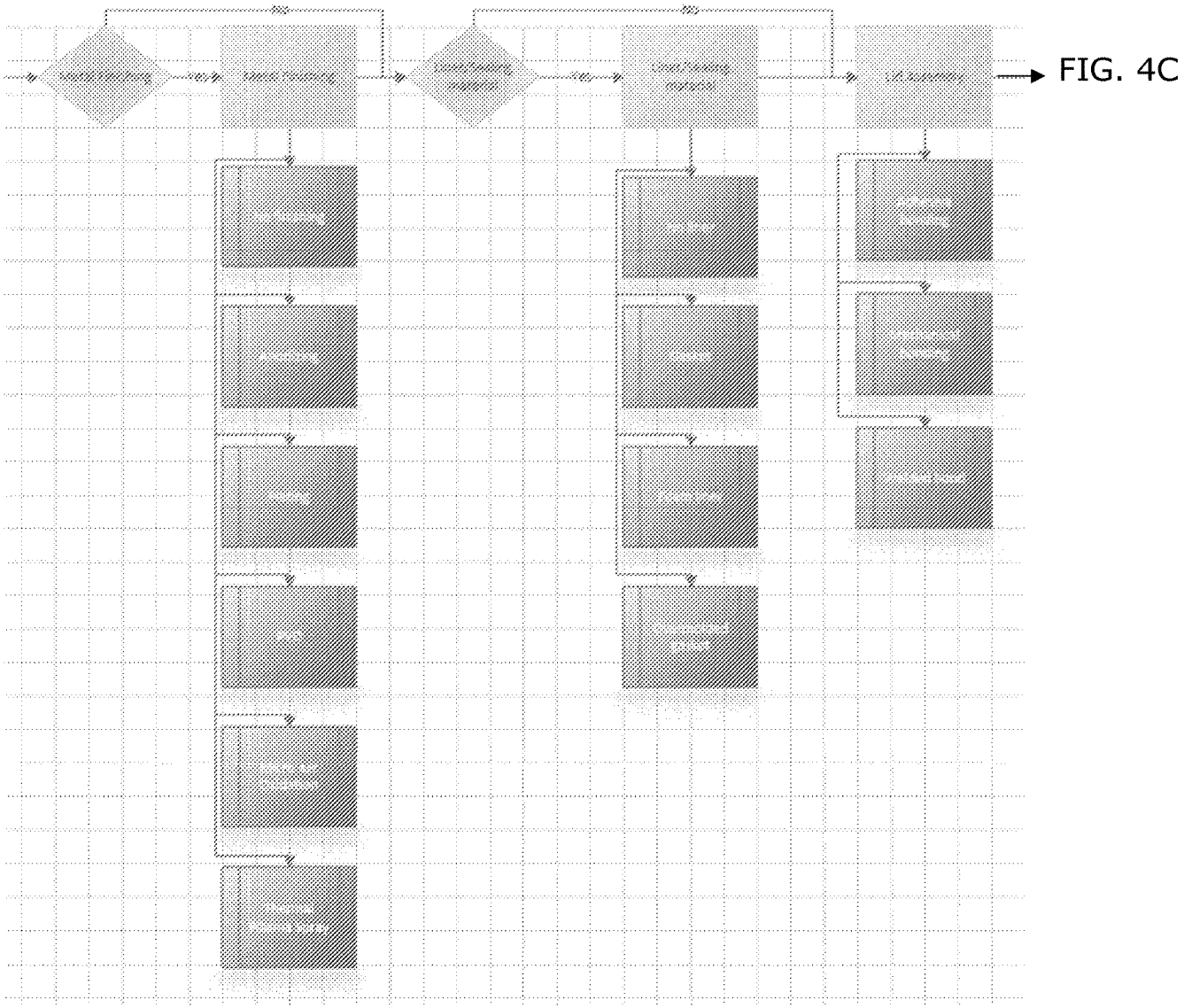
FIG. 4B is the second part of a schematic of a method of constructing jars according to the present disclosure.
Figures 4B, 4C:
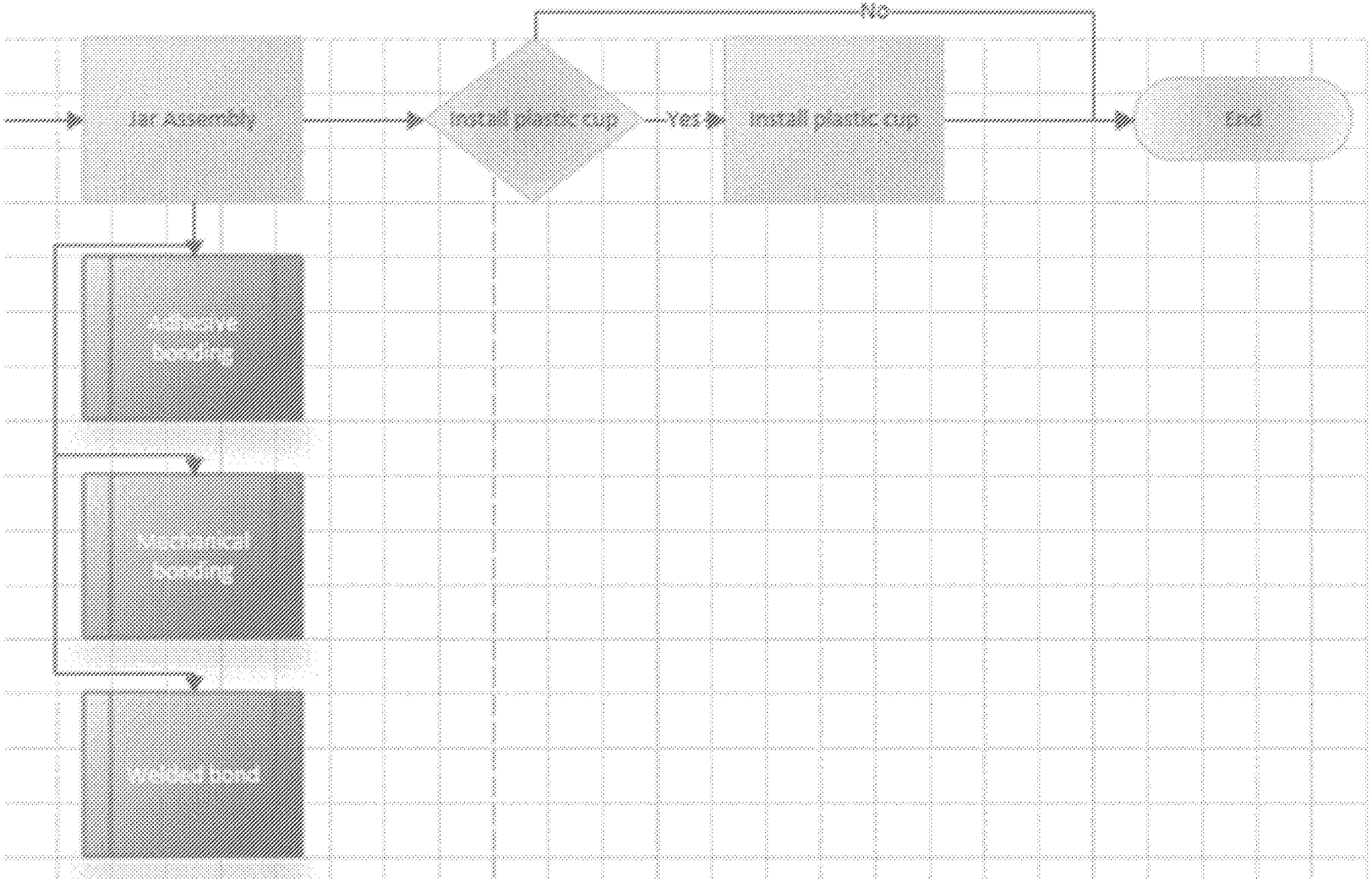
FIG. 4C is the third part of a schematic of a method of constructing jars according to the present disclosure.

FIGS. 4A-4C illustrate a flowchart of an exemplary process that may be utilized to manufacture the jar 100.

As shown in FIG. 4A, the manufacturing process begins with providing a primary material, or selecting a primary material. The primary material may be aluminum or aluminum alloys, e.g., 5657, 5005, 5052, 5182, 3004, 7075, 3005, 8052, and others known to one skilled in the art; steel, such as pre-coated tin plate, stainless steel or galvanized steel; titanium, or other metal materials adjudged suitable for use by one skilled in the art.

Optionally, the primary metal material may be pre-coated, such a by pre-coating the aluminum alloy, pre-anodizing the metal, or plating. Accordingly, the manufacturing process may include an optional step of precoating the selected material. In some embodiments, the selected material has no precoating. However, Aluminum alloys may be pre-coated with an inorganic barrier-type corrosion inhibitor, e.g., a composition comprising clay particles. In some embodiments, the selected material is pre-anodized. Pre-anodizing the material involves an electrochemical process that converts the metal surface into a decorative, durable, corrosion-resistant, anodic oxide finish. A typical chemical treatment process may involve removing dirt and oils, such as by treatment with an inhibited acid or alkaline cleaner, deoxidizing the material in strong acidic solution to remove natural oxides or heat-treat scale, and chemical etching or brightening. Strong acids or bases may be used to etch the material in order to provide a uniform, matte finish. Brightening, also known as micro-leveling or micro-smoothing, may be achieved by either chemical or electrochemical means, as would be known by one skilled in the art. Alternatively, the selected material may be plated, such as to increase corrosion protection, provide greater wear resistance or to enhance the appearance of a product. Electroplating or an autocatalytic reaction may be used. The plating material may be any commonly known in the art, such as zinc, tin, magnesium, silicon or other metals or metalloids.

Thereafter, the manufacturing process includes a metal forming step. The metal is formed to make the jar assembly and lid assembly, such as by deep draw, impact extrusion, roll forming or eyelet stamping. Deep drawing involves a hydraulic or mechanical press pushing the metal sheet via an appropriately shaped punch into a matching die. Impact extrusion utilizes a punch to press a slug at high velocity and force into the appropriately shaped die or mold. Roll forming passes the metal through a continuous bending operation to bend the metal into the desired shape of a jar assembly or lid.

FIG. 4B is a continuation of an exemplary manufacturing process, and it includes an optional step of metal finishing. The metal may be finished via anodizing, plating, physical vapor deposition (PVD), micro arc oxidation, and/or thermal plasma spray.

The jar assembly and lid assembly may optionally comprise a liner material and/or sealing material, by way of non-limiting examples a gasket, foam liner, or overmolded gasket. According, the manufacturing process may further include an optional step of providing a liner and/or seal.

The manufacturing process then includes the step of assembling the lid assembly. The assembly of the lid assembly, or the combining of the inner cap with the outer cap, may be carried out by means of adhesive bonding, mechanical bonding, welded bonding, or other methods known to one skilled in the art.

FIG. 4C further continues the depiction of an exemplary manufacturing process. As shown, the manufacturing process further includes the step of assembling the jar assembly, and this step may be performed before, after, or simultaneously with the step of assembling the lid assembly. The step of assembling the jar assembly be carried out by means of adhesive bonding, mechanical bonding, welded bond, or other methods known to one skilled in the art.

Following the step of assembling the jar assembly, the manufacturing process may include an optional step of installing a cup within the jar assembly. For example, a plastic cup may be installed within the jar assembly. In the illustrated example, the step of installing a cup is provided a final step; however, in other non-illustrated steps, the jar may be further subject to final decorating or design steps, including painting, etching, branding, adding graphics or decals, or providing other indicia as may be desirable for the final end use application.

Figure 5:
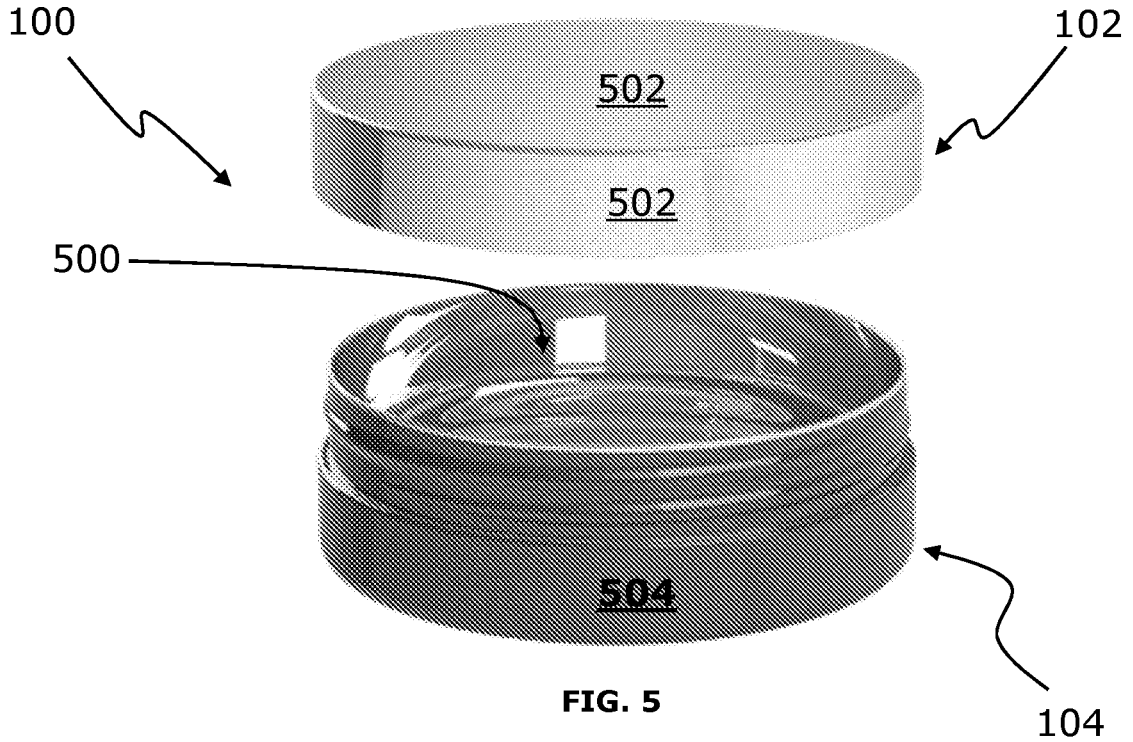
FIG. 5 is a perspective view of a jar assembly with the lid separated from the jar.
Figure 6:
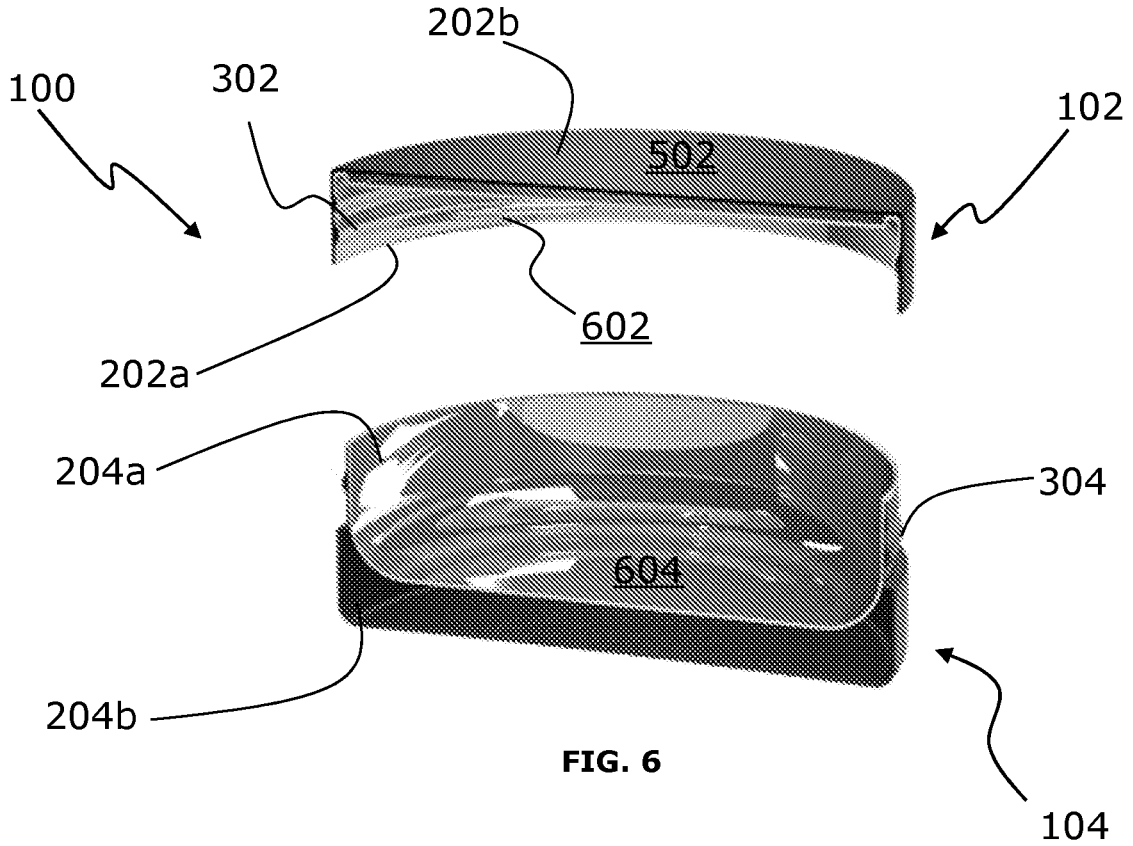
FIG. 6 is a sectional view of the jar of FIG. 5.

FIG. 5 shows the result of the exemplary manufacturing process, namely a perspective view of a jar formed via this process with the lid assembly elevated over the jar assembly. FIG. 6 is a sectional side view of the jar of FIG. 5.

Figure 7:
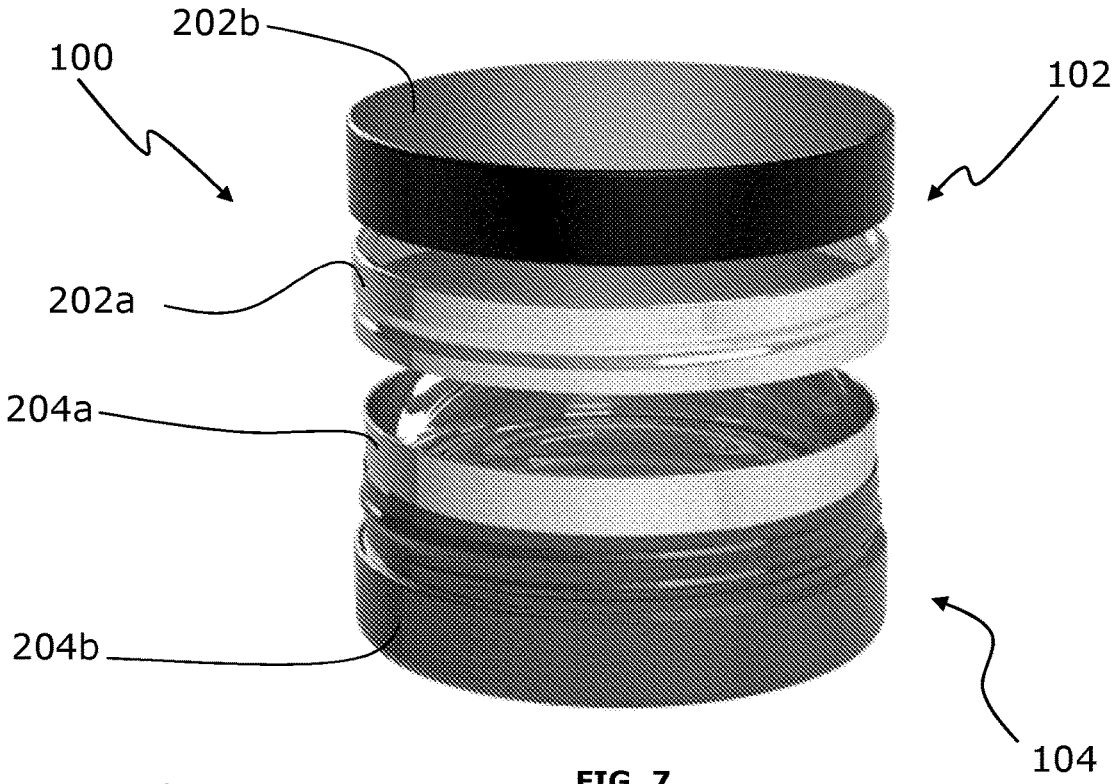
FIG. 7 is a perspective view of a jar of the present disclosure with the inner cups separated from the base and lid.
Figure 8:
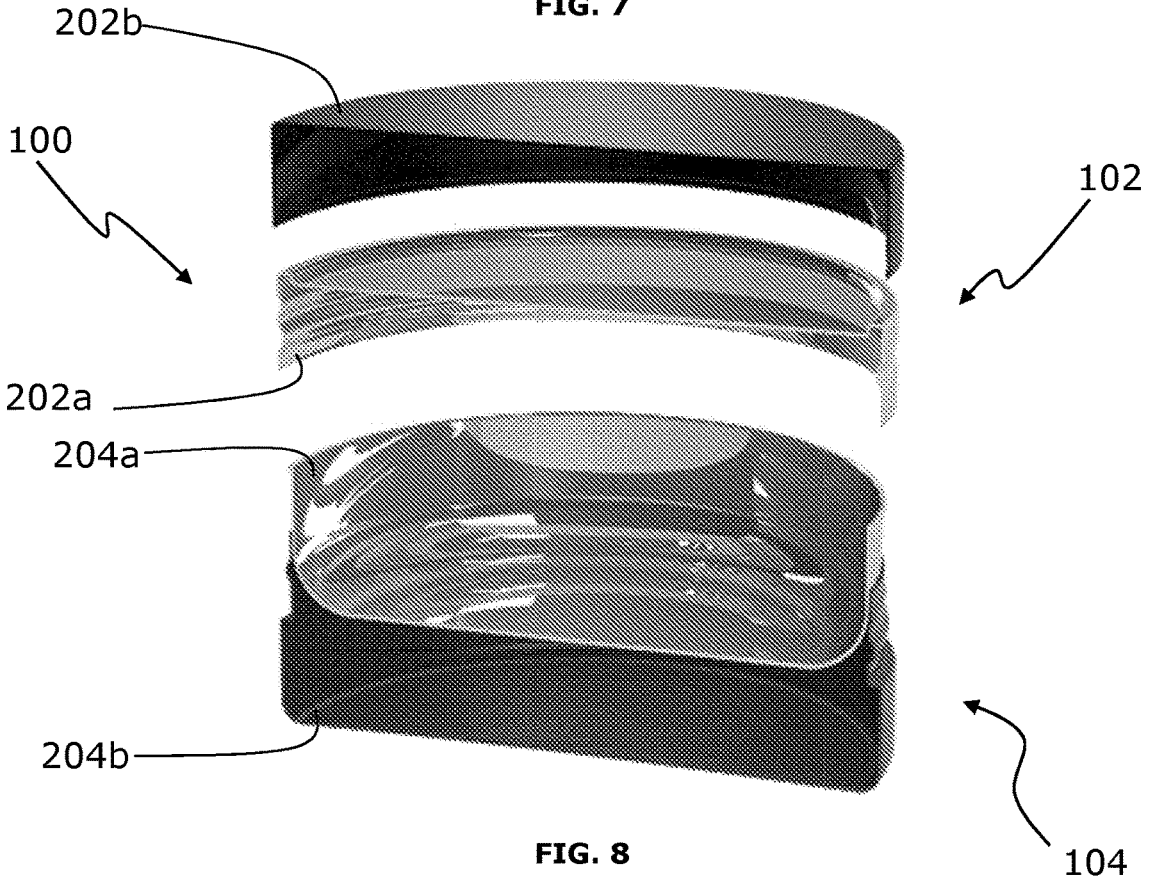
FIG. 8 is a sectional view of the jar of FIG. 7.

FIG. 7 depicts the jar assembly and lid assembly with the inner cup and inner cap separated from the outer cap and base of the jar. FIG. 8 depicts a sectional side view of the jar of FIG. 5.

Figure 9:
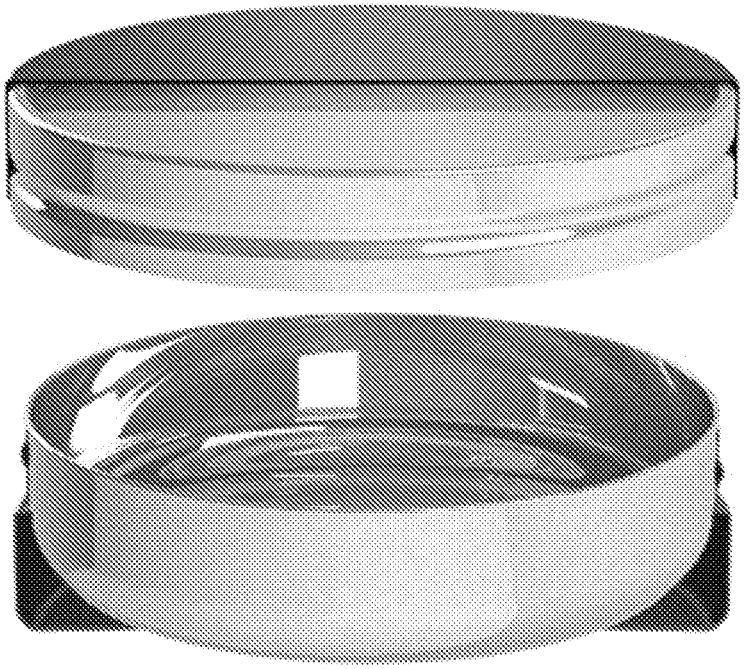
FIG. 9 is a partial sectional view of the jar of FIG. 7, showing the base and lid cut along a centerline, while the inner cups are whole.

FIG. 9 depicts the jar assembly and lid assembly with the outer cap and base in a cross-section along a midline of the cylindrical jar. The inner cup and inner cap are not sectioned, but are instead complete, thus depicting out the inner portions look absent the outer portions of the lid assembly and jar assembly.

Figure 10:
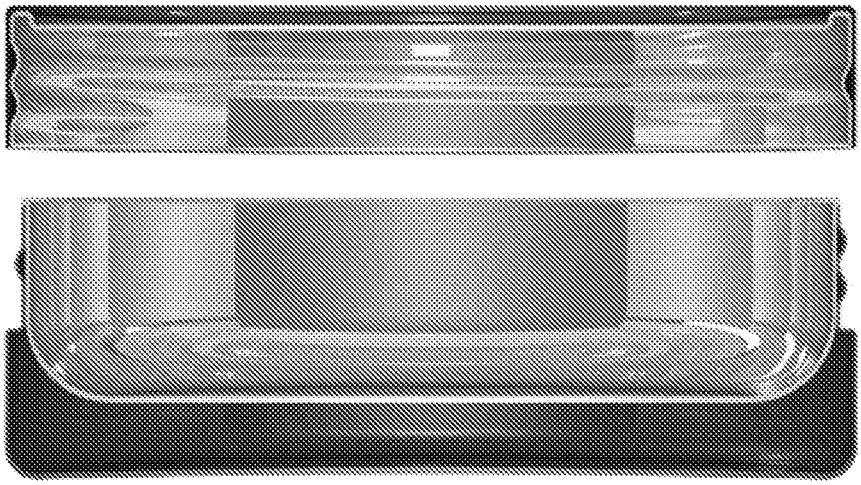
FIG. 10 is a sectional view of one embodiment of a jar of the present disclosure.
Figure 11:
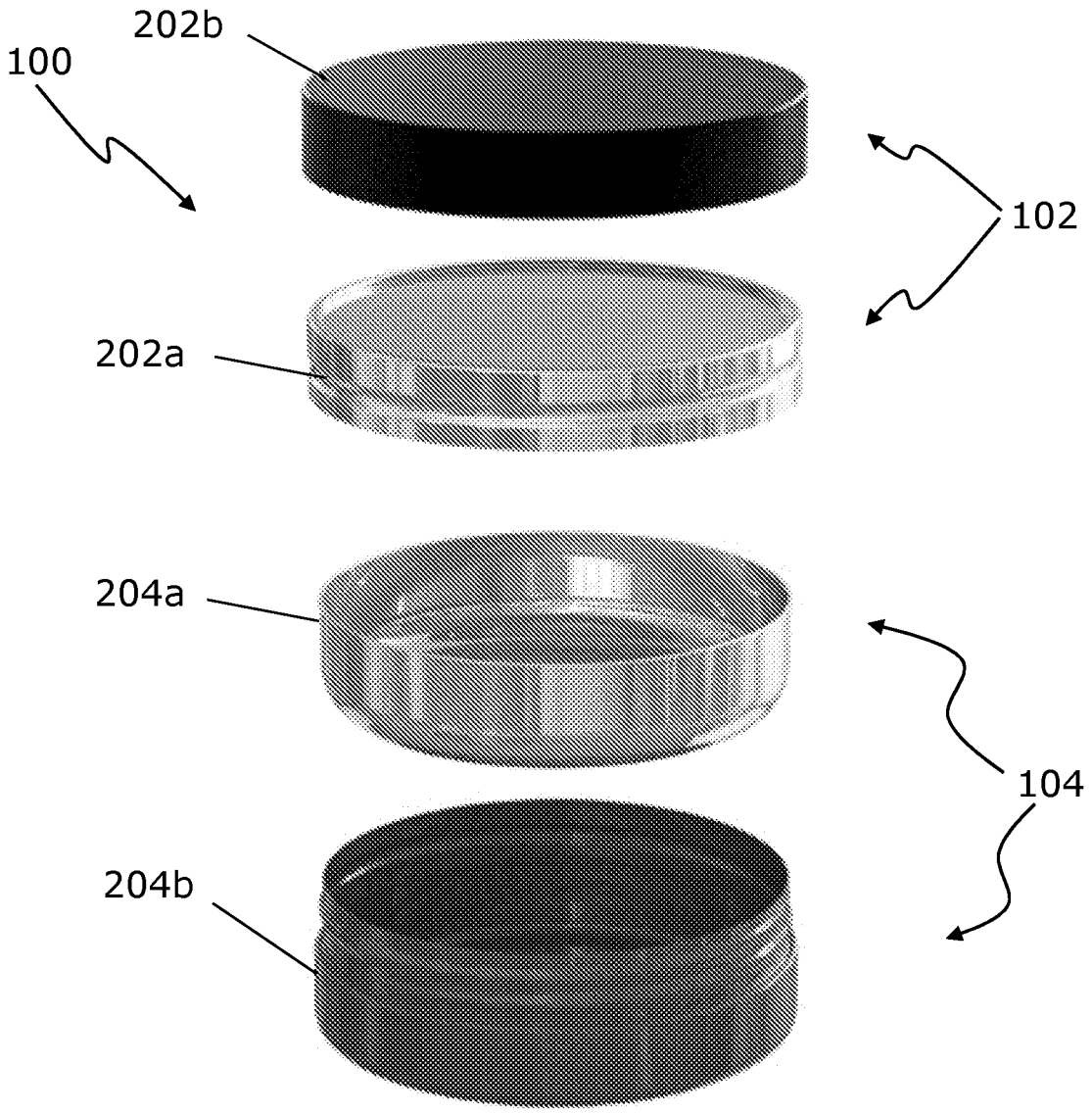
FIG. 11 is an exploded view of one embodiment of a jar of the present disclosure.

FIG. 10 is a sectional side view of a jar of the present disclosure with the lid assembly elevated over the jar assembly. Finally, FIG. 11 depicts an exploded view, with the inner caps 202*a*, 204*a* removed from the outer portions 204*a*, 204*b* of the jar assembly 104 and lid assembly 102.

This invention has been described with reference to illustrative embodiments, and is not meant to be construed in a limiting sense. It will be apparent to one skilled in the art that elements or process steps from one or more embodiments described herein may be used in combination with elements or process steps from one or more other embodiments described herein, and that the present invention is not limited to the specific embodiments provided herein but only as set forth in the accompanying claims. Various modifications of the illustrative embodiments, as well as additional embodiments to the invention, will be apparent to persons skilled in the art upon reference to this description

The invention claimed is:

1. A jar assembly, comprising:

a base comprising an aluminum base and a first aluminum inner cup provided within a first cavity defined within the aluminum base, wherein an outer thread is provided about an exterior surface of the aluminum base; and a two-piece lid comprising an aluminum lid and an inner aluminum cup bonded within a second cavity defined within the aluminum lid, wherein an inner thread mateable with the outer thread is provided about an interior surface of the inner aluminum cup, wherein the aluminum lid is anodized.

2. The jar assembly of claim 1, wherein the aluminum base and the aluminum lid are cylindrical in shape.

3. The jar assembly of claim 1, wherein the outer thread is provided on a neck of the aluminum base.

4. The jar assembly of claim 1, wherein one or both of the interior surfaces of the first aluminum inner cup and the inner aluminum cup have an FDA-approved polymeric coating applied thereto.

5. The jar assembly of claim 4, wherein the FDA-approved coating is an epoxy powdercoat.

6. The jar assembly of claim 1, wherein the first aluminum inner cup, the aluminum base, the aluminum lid and the inner aluminum cup all comprise a recyclable aluminum material.

7. The jar assembly of claim 1, wherein the aluminum base, first aluminum inner cup, aluminum lid and inner aluminum cup are formed via deep drawing.

8. The jar assembly of claim 1, wherein the aluminum base, first aluminum inner cup, aluminum lid and inner aluminum cup are formed via impact extrusion.

9. The jar assembly of claim 1, wherein the aluminum lid does not comprise threads.

10. The jar assembly of claim 1, wherein the aluminum lid covers the inner thread provided on the inner aluminum cup such that the inner thread is not visible or exposed from an exterior of the lid.

11. The jar assembly of claim 1, wherein the aluminum lid covers the inner thread provided on the inner aluminum cup such that, when the lid is assembled on the base, neither the inner thread nor the outer thread is visible or exposed.

12. A jar assembly, comprising:

an aluminum base and a first aluminum inner cup provided within a first cavity defined within the aluminum base, and an outer thread is provided about an exterior surface of the aluminum base; and a two-piece aluminum lid comprising:

a substantially cylindrical threadless aluminum outer cap having a substantially planar outer cap top wall and an outer cap sidewall defining a lid cavity; and a substantially cylindrical aluminum inner cap having an inner cap top wall and inner cap sidewall, the aluminum inner cap nested within the lid cavity of the aluminum outer cap and bonded thereto, the aluminum inner cap further including an inner thread provided about an interior surface of the inner cap sidewall wherein an edge of the outer cap sidewall is substantially parallel to an edge of the inner cap sidewall.

13. The jar assembly according to claim 12, wherein the outer cap sidewall extends beyond the inner cap sidewall.

14. The jar assembly according to claim 12, wherein the inner cap and outer cap are secured together with an adhesive.

15. The jar assembly according to claim 12, wherein the inner cap top wall further includes a recess, the recess creating a gap between the outer cap top wall and inner cap top wall when assembled.

16. A two piece aluminum lid for a jar assembly, comprising:

a substantially cylindrical threadless aluminum outer cap having a substantially planar outer cap top wall and an outer cap sidewall defining a lid cavity; and an substantially cylindrical aluminum inner cap having an inner cap top wall and inner cap sidewall, the aluminum inner cap nested within the lid cavity of the aluminum outer cap and bonded thereto, the aluminum inner cap further including an inner thread provided about an interior surface of the inner cap sidewall.

17. The two piece aluminum lid according to claim 16, wherein the outer cap sidewall extends beyond the inner cap sidewall.

18. The two piece aluminum lid according to claim 16, wherein the inner cap and outer cap are bonded with an adhesive.

19. The jar assembly according to claim 16, wherein the inner cap top wall further includes a recess, the recess creating a gap between the outer cap top wall and inner cap top wall when assembled.

20. The two piece aluminum lid according to claim 16, wherein an end of the outer cap sidewall is substantially parallel to an end of the inner cap sidewall.

* * * * *